US011143438B2

(12) United States Patent
Cho et al.

(10) Patent No.: US 11,143,438 B2
(45) Date of Patent: Oct. 12, 2021

(54) COMPRESSOR AND REFRIGERATOR HAVING THE SAME

(71) Applicant: LG Electronics Inc., Seoul (KR)

(72) Inventors: Jaeho Cho, Seoul (KR); Dowan Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 105 days.

(21) Appl. No.: 16/358,244

(22) Filed: Mar. 19, 2019

(65) Prior Publication Data

US 2020/0080752 A1 Mar. 12, 2020

(30) Foreign Application Priority Data

Sep. 11, 2018 (KR) ..... 10-2018-0108544

(51) Int. Cl.

| | |
|---|---|
| ***F25B 1/00*** | (2006.01) |
| ***F25D 29/00*** | (2006.01) |
| ***F04B 53/08*** | (2006.01) |
| ***F04C 29/04*** | (2006.01) |
| ***F25B 31/00*** | (2006.01) |
| ***F04B 39/06*** | (2006.01) |

(52) U.S. Cl.

CPC ..... *F25B 1/005* (2013.01); *F04B 39/06* (2013.01); *F04B 53/08* (2013.01); *F04C 29/04* (2013.01); *F25B 31/006* (2013.01); *F25D 29/005* (2013.01); *F04C 29/045* (2013.01); *F04C 2240/805* (2013.01); *F25B 2300/00* (2013.01); *F25B 2400/07* (2013.01); *F25B 2400/071* (2013.01)

(58) Field of Classification Search

CPC ..... F04B 53/08; F04B 39/06; F04C 29/04; F04C 29/045; F25D 23/003; F25B 1/005; F25B 31/006; F25B 2400/071; F25B 2300/00; F25B 2400/07

USPC ..... 62/439

See application file for complete search history.

(56) References Cited

U.S. PATENT DOCUMENTS

| | | |
|---|---|---|
| 2005/0074354 A1 | 4/2005 | Ebara et al. |
| 2013/0045119 A1 | 2/2013 | Junior et al. |

FOREIGN PATENT DOCUMENTS

| | | |
|---|---|---|
| CN | 201162642 | 12/2008 |
| CN | 201671795 | 12/2010 |

(Continued)

OTHER PUBLICATIONS

Extended European Search Report in European Application No. 19151842.2, dated May 24, 2019, 11 pages.

(Continued)

*Primary Examiner* — Steve S Tanenbaum

(74) *Attorney, Agent, or Firm* — Fish & Richardson P.C.

(57) ABSTRACT

A compressor includes a shell that defines an enclosed space inside the shell, an electric motor unit located in the enclosed space of the shell and configured to generate a driving force, and a compression unit located in the enclosed space of the shell and configured to compress refrigerant. The compression unit includes a cylinder and a piston that is configured to reciprocate in the cylinder based on the driving force transmitted from the electric motor unit. The shell includes a plurality of heat radiation fins that are located at an outer circumferential surface of the shell and that are configured to emit heat generated inside the shell to an outside of the shell.

20 Claims, 12 Drawing Sheets

(56) References Cited

FOREIGN PATENT DOCUMENTS

| | | | | |
|---|---|---|---|---|
| CN | 201812859 | | | 4/2011 |
| CN | 102667157 | | | 9/2012 |
| CN | 105464948 | | | 4/2016 |
| CN | 105464948 | A | * | 4/2016 |
| FR | 1033865 | | | 7/1953 |
| KR | 1019970045516 | | * | 7/1997 |
| KR | 100190121 | | | 6/1999 |
| KR | 100190121 | B1 | * | 6/1999 |
| KR | 2020010002247 | | | 10/2001 |
| KR | 1020180090057 | | | 8/2018 |
| WO | WO2007107514 | | | 9/2007 |
| WO | WO2018151493 | | | 8/2018 |

OTHER PUBLICATIONS

CN Office Action in Chinese Appln. No. 201910636526.1. dated Jan. 8, 2021, 11 pages (with English translation).
CN Office Action in Chinese Appln. No. 201910636526.1, dated Jun. 25, 2021, 16 pages (with English translation).

* cited by examiner

COMPRESSOR AND REFRIGERATOR HAVING THE SAME

CROSS-REFERENCE TO RELATED APPLICATIONS

This application claims the benefit of an earlier filing date of and the right of priority to Korean Application No. 10-2018-0108544, filed on Sep. 11, 2018, which is herein expressly incorporated by reference in its entirety.

TECHNICAL FIELD

The present disclosure relates to a compressor having an aluminum shell and a refrigerator having the same.

BACKGROUND

A refrigerator is a device that can store objects such as food, beverage, and the like and keep the objects fresh for a certain period. For example, the refrigerator may store food items in a cavity at a freezing or refrigeration temperature according to the type of the food items.

The refrigerator may include a compressor and be operated by driving the compressor. For example, cool air supplied to the cavity of the refrigerator may be generated by the heat exchange function of refrigerant, where the cool air may be continuously or intermittently supplied to an inside of the refrigerator as the cavity temperature rises and falls based on repeatedly performing a cooling cycle including compression, condensation, expansion, and evaporation. In some cases, the supplied refrigerant is uniformly transferred to the inside of the cavity by convection to store food inside the refrigerator at a desired temperature.

In recent years, a demand for vehicle-mountable or movable small refrigerators has been increased due to an increased interest in leisure, where the small refrigerators may demand an improved cooling efficiency. For small refrigerators, supply of vehicle refrigerators which are fixedly mounted and used on a vehicle has also been increased. An increase in demand for small refrigerators is leading to an increase in demand for small compressors.

In some cases, a small compressor may have a compression mechanism that is the same as or substantially similar to that of a large compressor. In some cases, in the small compressor, heat may not be quickly discharged to an outside of the compressor due to a relatively reduced heat emission area. As a result, an internal temperature of the compressor may be increased, which may deteriorate the reliability of components in the compressor as well as a motor efficiency.

In some cases, a refrigerator with a small compressor may include a fan installed in a machine room of the refrigerator to discharge heat of the compressor. In such cases, an area of the machine room may be increased, which may reduce a storage space of the refrigerator compared to the refrigerator of the same capacity. In some cases, a manufacturing cost may increase as the number of parts increases due to the installation of the fan. In some cases, the efficiency of the refrigerator may decrease, and a noise level may increase as the operation time of the fan increases for emitting heat from the compressor.

SUMMARY

One object of the present disclosure may be to provide a small compressor capable of rapidly emitting heat generated inside a shell.

In some implementations, a heat radiation fin may be installed on an outer surface of the shell, where the small compressor may have a reduced dead angle or dead volume generated by the heat radiation fin to minimize an area occupied by the compressor.

Another object of the present disclosure may be to provide a refrigerator that can reduce manufacturing cost as well as increase an area of storage space by excluding the fan when the compressor is applied to the refrigerator.

In some implementations, the refrigerator may increase the efficiency of the refrigerator and reduce noise by minimizing an operation time of the fan when the fan is installed.

According to one aspect of the subject matter described in this application, a compressor includes a shell that defines an enclosed space inside the shell, an electric motor unit located in the enclosed space of the shell and configured to generate a driving force, and a compression unit located in the enclosed space of the shell and configured to compress refrigerant. The compression unit includes a cylinder and a piston that is configured to reciprocate in the cylinder based on the driving force transmitted from the electric motor unit. The shell includes a plurality of heat radiation fins that are located at an outer circumferential surface of the shell and that are configured to emit heat generated inside the shell to an outside of the shell.

Implementations according to this aspect may include one or more of the following features. For example, at least a part of the outer circumferential surface of the shell may define a curved part, and each of the plurality of heat radiation fins may be located at the curved part of the outer circumferential surface of the shell. In some examples, the shell has a side central portion, an upper central portion located vertically above the side central portion, and a bottom central portion located vertically below the side central portion. In this example, a cross-section area of the upper central portion or the bottom central portion of the shell is less than a cross-section area of the side central portion of the shell, and each of the plurality of heat radiation fins is located between the upper central portion and the side central portion or between the bottom central portion and the side central portion.

In some implementations, each of the plurality of heat radiation fins may include a curved portion that is in contact with the outer circumferential surface of the shell, a vertical portion that extends in an axial direction for the shell from a first end of the curved portion, and a horizontal portion that extends from a second end of the curved portion in a direction perpendicular to the vertical portion. In some implementations, the shell may include a cover shell and a base shell that are coupled to each other to define the enclosed space, where the cover shell defines a first opening surface, and the base shell defines a second opening surface that faces the first opening surface of the cover shell, and the plurality of heat radiation fins are located at at least one of the cover shell or the base shell. In some cases, a surface area of the plurality of heat radiation fins located at the cover shell is greater than a surface area of the plurality of heat radiation fins located at the base shell.

In some examples, the cover shell and the base shell may include fastening protrusion portions that extend in a radial direction of the shell, that are configured to face each other, and that are located at positions corresponding to the first opening surface and the second opening surface, respectively. In this example, the base shell and the cover shell are configured to be coupled to each other by fastening bolts through the fastening protrusion portions of the cover shell and the based shell. In some examples, at least one of the cover shell or the base shell may include a stepped portion or a protrusion that is configured to couple the first opening surface and the second opening surface to each other.

In some implementations, the outer circumferential surface of the shell may include an upper side portion, a side wall portion, a lower side portion, and an edge portion that connects between the upper side portion and the side wall portion. In some examples, at least one of the plurality of heat radiation fins is located at the edge portion, and the plurality of heat radiation fins and the outer circumferential surface of the shell define a hexahedron shape comprising (i) one or more first planes defined by an end portion surface of the plurality of heat radiation fins and (ii) one or more second planes defined by the outer circumferential surface of the shell. In some examples, each of the plurality of heat radiation fins has a surface that extends in a direction parallel to at least one side of the hexahedron shape.

In some examples, each of the plurality of heat radiation fins extends in a plurality of directions that are parallel to orthogonal sides of the hexahedron shape, respectively. In some examples, each of the plurality of heat radiation fins extends radially with respect to a center of at least one side of the hexahedron shape. In some implementations, the shell may include a support portion that extends from a bottom portion of the shell and that is configured to support the shell. In some implementations, the shell is made of an aluminum material.

According to another aspect, a refrigerator includes a cavity configured to store one or more food items, a door configured to open and close at least a portion of the cavity, a machine room that is located at a side of the cavity, the machine room defining an air path that allows an inner space of the machine room to communicate with an outside of the machine room, a condenser located in the inner space the machine room, and a compressor located in the inner space of the machine room at a side of the condenser. The compressor includes a shell that defines an enclosed space and that is made of an aluminum material, an electric motor unit located in the enclosed space of the shell and configured to generate a driving force, and a compression unit located in the enclosed space of the shell and configured to compress refrigerant. The compression unit includes a cylinder and a piston that is configured to reciprocate in the cylinder based on the driving force transmitted from the electric motor unit. The shell includes a plurality of heat radiation fins that are located at an outer circumferential surface of the shell and that are configured to emit heat generated inside the shell to an outside of the shell.

Implementations according to this aspect may include one or more of the following features and the features described above with respect to the compressor. For example, each of the plurality of heat radiation fins may extend toward the condenser. In some examples, each of the plurality of heat radiation fins extends in a first direction perpendicular to a second direction extending toward the condenser.

In some implementations, the machine room may include an air inlet configured to receive air from the outside of the machine room, and an air outlet spaced apart from the air inlet and configured to discharge air to the outside of the machine room, the air path extending from the air inlet toward the air outlet, where the condenser and the compressor are located between the air inlet and the air outlet.

In some implementations, the refrigerator may further include a fan located between the condenser and the compressor. In some examples, the refrigerator may further include a controller that is configured to control the compressor, that is coupled to the shell of the compressor, and that is located between the fan and the shell of the compressor.

BRIEF DESCRIPTION OF THE DRAWING

The accompanying drawings, which are included to provide a further understanding of the disclosure and are incorporated in and constitute a part of this specification, illustrate implementations of the disclosure and together with the description serve to explain the principles of the disclosure.

FIGS. 14 to 16 are views showing example implementations of a first heat radiation fin and an example arrangement shape of the first heat radiation fin, in which FIGS. 14 and 15 are front views seen from a condenser side, and FIG. 16 is a plan view seen from an upper side.

DETAILED DESCRIPTION

Hereinafter, a small compressor according to the present disclosure and a refrigerator to which the small compressor is applied will be described in detail based on an implementation illustrated in the accompanying drawings.

The implementations relate to a vehicle-mountable or movable refrigerator and a small compressor applied to the refrigerator, but the scope of application is not limited thereto. Hereinafter, a small compressor according to one or more implementations and a refrigerator to which the small compressor is applied will be described with reference to a refrigerator mounted on a vehicle for convenience of explanation.

Figure 1:
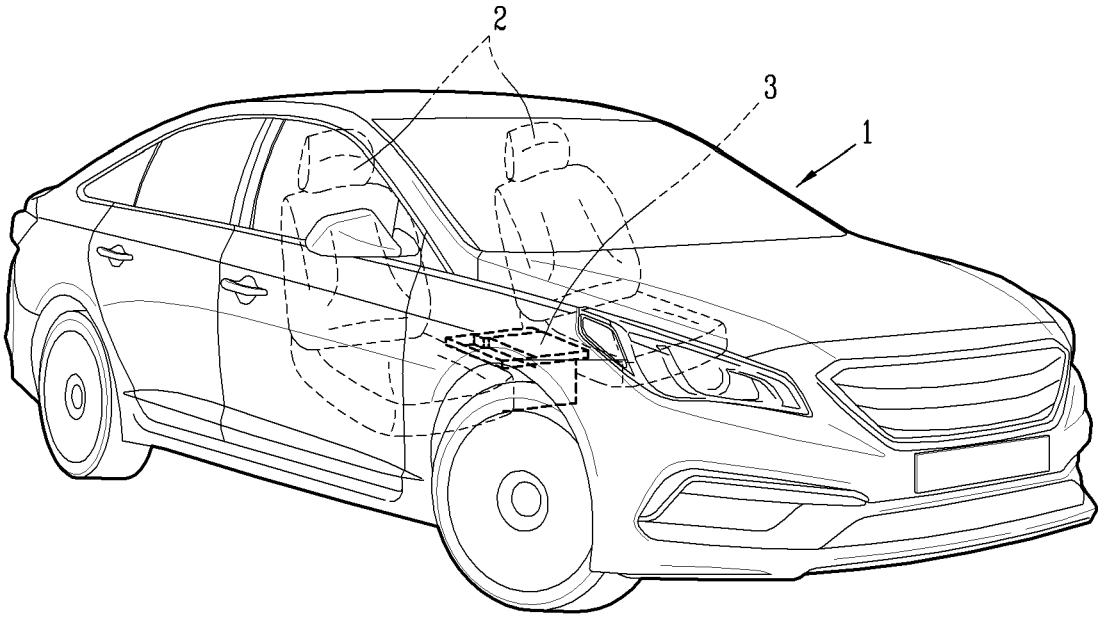
FIG. 1 is a perspective view showing an example vehicle.

FIG. 1 is a perspective view of an example vehicle according to one or more implementations. Referring to FIG. 1, the vehicle 1 includes seats 2 on which users can sit. The seats 2 are spaced apart from each other on the left and right sides, and at least one pair may be provided. A console is provided between the seats 2, and a driver places articles necessary for driving therein or parts necessary for the operation of the vehicle is stored in the console.

The small refrigerator may be located in the console. However, the present disclosure is not limited thereto, and may be installed in various spaces. For example, it may be installed in a space between rear seats, a door, a glove box, and a center fascia. It is because a vehicle refrigerator in the implementation can be installed only when power is supplied and a minimum space is secured.

Figure 2:
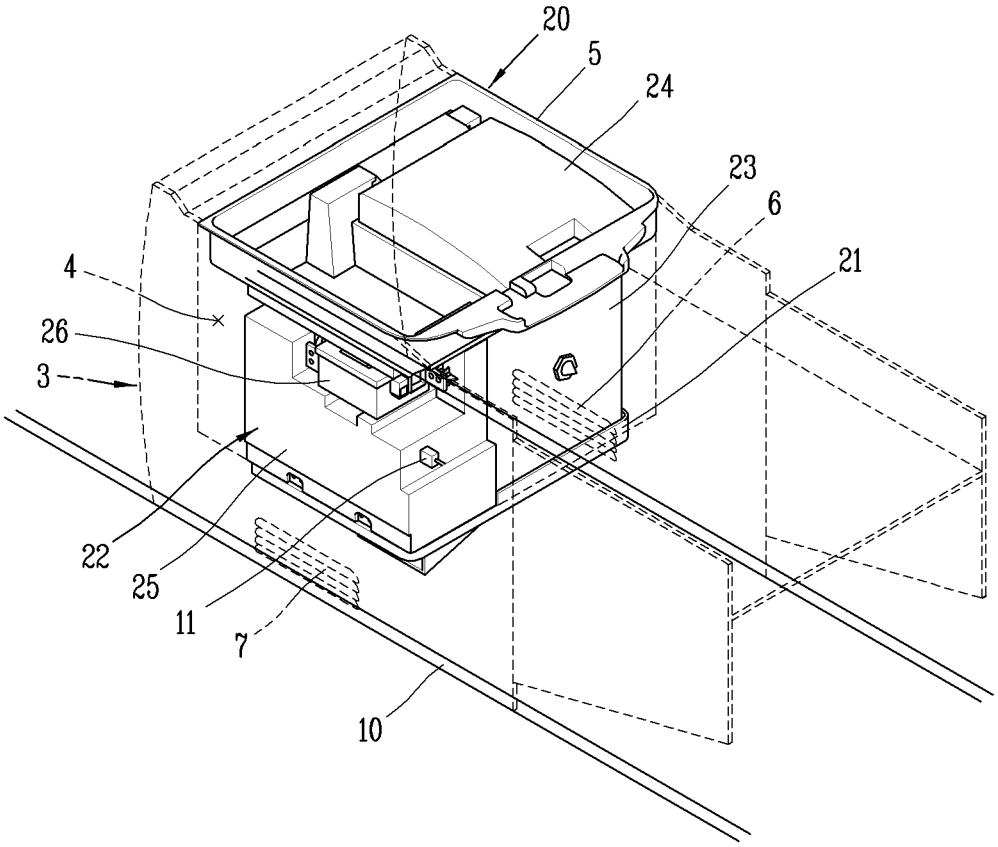
FIG. 2 is an enlarged perspective view showing an example console of the vehicle in FIG. 1.

FIG. 2 is an enlarged perspective view showing an example console of the vehicle according to FIG. 1. Referring to FIG. 2, a console 3 may be formed with a separate part made of resin or the like. A steel frame 10 may be provided on a lower side of the console 3, and a sensor element 11 such as a sensor may be placed in a spacing portion between the console 3 and the steel frame 10. The sensor element 11 may correspond to a part that requires accurate external signal sensing and signal measurement at a driver's position. For example, an airbag sensor directly associated with the driver's life may be mounted thereon.

The console 3 has a console space 4 therein, and a console space 4 may be covered by a console cover 5. The console cover 5 may be fixedly fixed to the console 3. As a result, the console cover 5 makes it difficult for external foreign matter to enter the console through the console cover 5. A vehicle refrigerator 20 is placed inside the console space 4.

An air inlet 6 is provided on a right side of the console 3 to allow air inside the vehicle to flow into the console space 4. The air inlet 6 may be seen on the driver's side. An exhaust port 7 is provided on a left side of the console 3 to exhaust air warmed during the operation of the vehicle refrigerator inside the console space 4. The exhaust port 7 may be seen on the assistant driver's side. The air inlet 6 and the exhaust port 7 are provided with a grill so as to make it difficult for a user's hand to enter, thereby ensuring the user's safely, and the grill may prevent an object falling from above from entering thereinto, and direct the direction of wind to be exhausted downward so as not to direct to the person.

The refrigerator 20 is provided with a refrigerator bottom frame 21 for supporting the components, a machine room 22 provided on a left side of the refrigerator bottom frame 21, and a cavity 23 provided on a right side of the refrigerator bottom frame 21. The machine room 22 may be covered by a machine room cover 25, and an upper side of the cavity 23 may be covered by the console cover 5 and the door 24.

The machine room cover 25 may guide the flow path of cooling air as well as block foreign matter from entering the machine room. A refrigerator controller 30 is placed above the machine room cover 25 to control the entire operation of the small refrigerator 20.

As the refrigerator controller 26 is installed on an upper side of the machine room cover 25, the small refrigerator 20 may be operated without any problem in a proper temperature range in a narrow space inside the console space 4. In other words, the refrigerator controller 26 may be cooled by air flowing in a space between the machine room cover 25 and the console cover 5, and separated from an inner space of the machine room 22 by the machine room cover 25, and thus heat inside the machine room 22 may not have an effect thereon.

The console cover 5 may not only shield an open portion at an upper portion of the console space 4 but also shield an upper edge of the cavity 23. A door 24 may be further provided on the console cover 5 to enable the user to shield an opening allowing an article to be taken out of the cavity 23. The door 24 may open the console cover 5 and a back portion of the cavity 23 to the hinge point. Here, the console cover 5, the door 24 and an opening of the cavity 23 are horizontally placed when viewed by the user and positioned at a rear portion of the console 3 to allow the user to conveniently manipulate the door 24.

Figure 3:
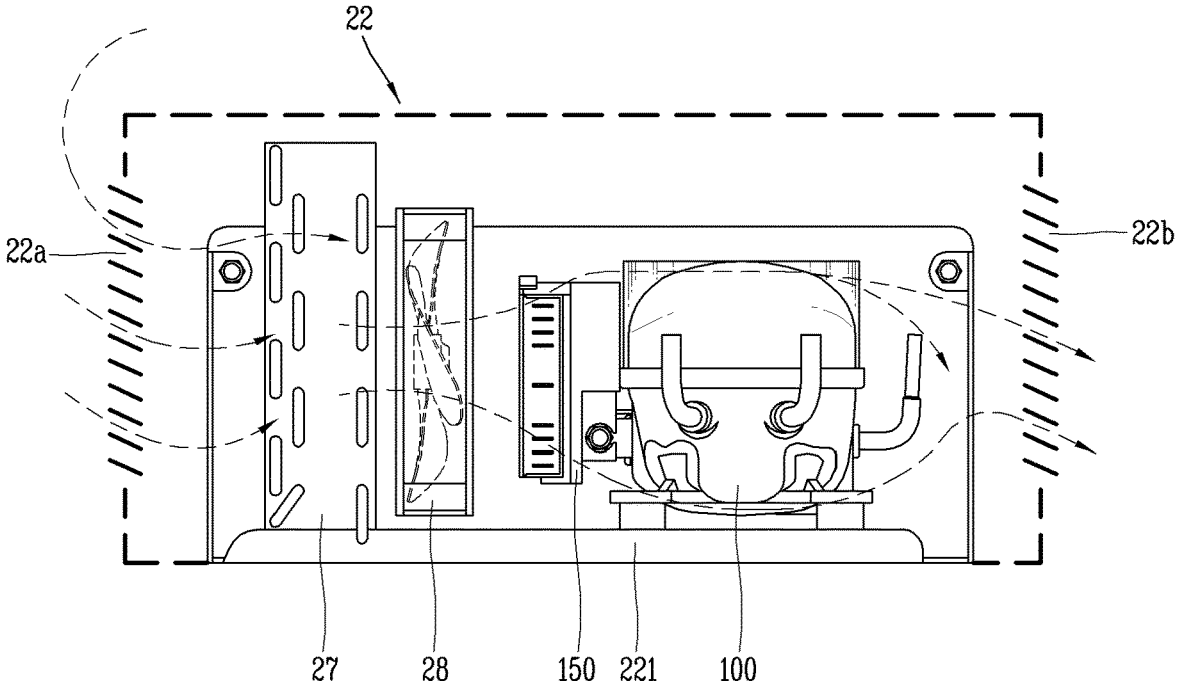
FIG. 3 is a front view schematically showing an example machine room of an example small refrigerator.
Figure 4:
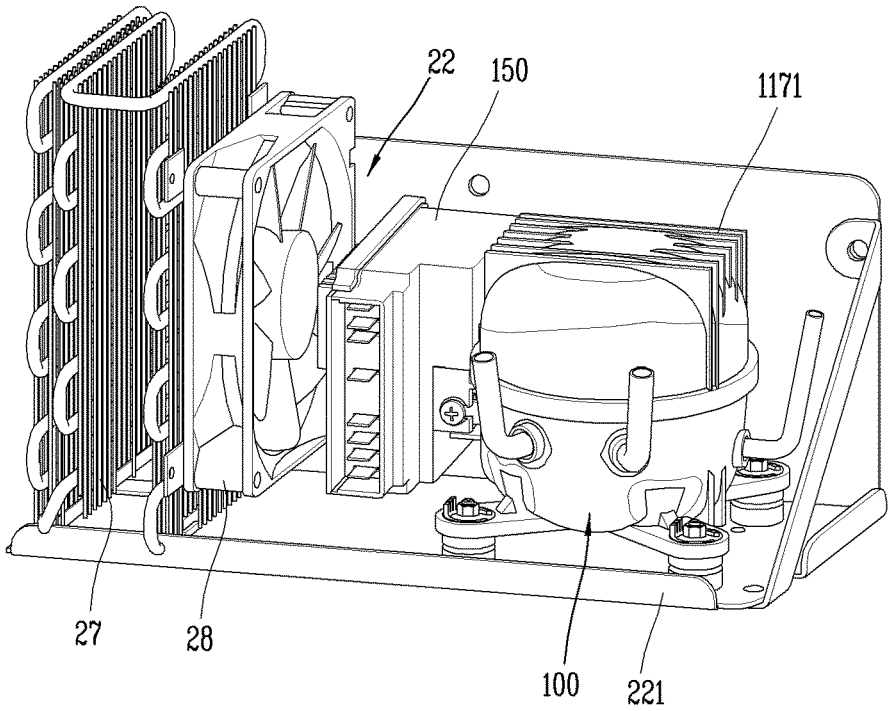
FIG. 4 is a perspective view showing an example of an inside of the machine room in FIG. 3.

FIG. 3 is a front view schematically showing an example of a machine room of a small refrigerator, and FIG. 4 is a perspective view showing an example of an inside of the machine room in FIG. 3. Referring to FIG. 3, an air inlet 22*a* is formed at one side (left side in the drawing) of the machine room 22 and an air outlet 22*b* is formed at the other side (right side in the drawing) of the machine room 22. The air outlet 22*b* is illustrated on the right side on the drawing, but usually formed on the right bottom side. However, for convenience of explanation, the air outlet is illustrated on the right side.

A condenser 27, a condensing fan 28, and a compressor 100 are sequentially installed inside the machine room 22 along the flow direction of cooling air. The condenser 27 may be fastened by a rear fastening element of a machine room bottom frame 221. Air suctioned through the condenser 27 cools the compressor 100 and then flows out to a right side or a lower right side of the compressor 100.

The aforementioned condensing fan 28 is provided between the condenser 27 and the compressor 100. The condensing fan 28 is unable to increase rotational speed infinitely due to the effect of noise. According to an experiment, it is seen that a level of about 2,000 rpm does not have an effect on the driver.

In some implementations, the condensing fan is not necessarily installed. For example, in the case of a refrigerator, the condensing fan 28 may not be installed when refrigerant can be condensed only by heat exchange due to convection without the condensing fan 28. However, the condensing fan 28 performs the role of not only condensing refrigerant passing through the condenser 27 but also emitting the heat of the compressor 100. Therefore, when the heat of the compressor 100 is efficiently emitted, it may not be required to install the condensing fan 28 or the operation time may be reduced even when the condensing fan 28 is installed. It will be described again later together with the compressor.

The flow process of air in the machine room of the small refrigerator is as follows. In other words, air suctioned into the machine room 22 by the condensing fan 28 may condense refrigerant while passing through the condenser 27. The air passes through a dryer and an expansion valve, and then cools the compressor 100 and is discharged to the outside. At this time, the flow of air is a flow from a rear side of the machine room 22 toward a front side thereof. Based on FIG. 3, the left side is the rear side, and the right side is the front side.

The air that has cooled the compressor 100 may be discharged through the air outlet 22*b* provided on a side surface of the machine room or the machine room bottom frame 221. The air discharged through the air outlet 22*b* may be discharged to an outside of the vehicle refrigerator 20 through a flow guide provided in the refrigerator bottom frame 21.

In some implementations, as described above, the compressor may be a small compressor in which a surface area of the shell is reduced by about 70% as compared with a compressor applied to a domestic refrigerator in the related art. Accordingly, motor heat or compression heat generated inside the compressor cannot be efficiently and quickly emitted. As a result, it may reduce wear resistance on internal parts in the compressor or reduce the efficiency of the motor.

Furthermore, when the condensing fan is provided in consideration of this, manufacturing cost increases, and when the condensing fan is operated for a long period of time, power consumption increases and fan noise increases, thereby causing the passenger to feel uncomfortable. Thus, as illustrated in the present implementation, the shell of the small compressor may be made of an aluminum alloy having light weight and high heat transfer coefficient to enhance the heat radiation effect. A plurality of heat radiation fins may be formed on the surface of the shell to further enhance the heat radiation effect. Through this, it may be possible to minimize the fan operation time even when excluding or installing the condensing fan, thereby enhancing the efficiency of the refrigerator and increasing reliability.

The small compressor 100, which is one of the main elements of the refrigerator, may be divided into a reciprocating compressor, a rotary compressor, and a scroll compressor according to the driving method. In the present implementation, an example in which a connection type reciprocating compressor, which is a type of reciprocating compressor, is applied will be mainly described. However, the type of the compressor is not limited thereto.

Figure 5:
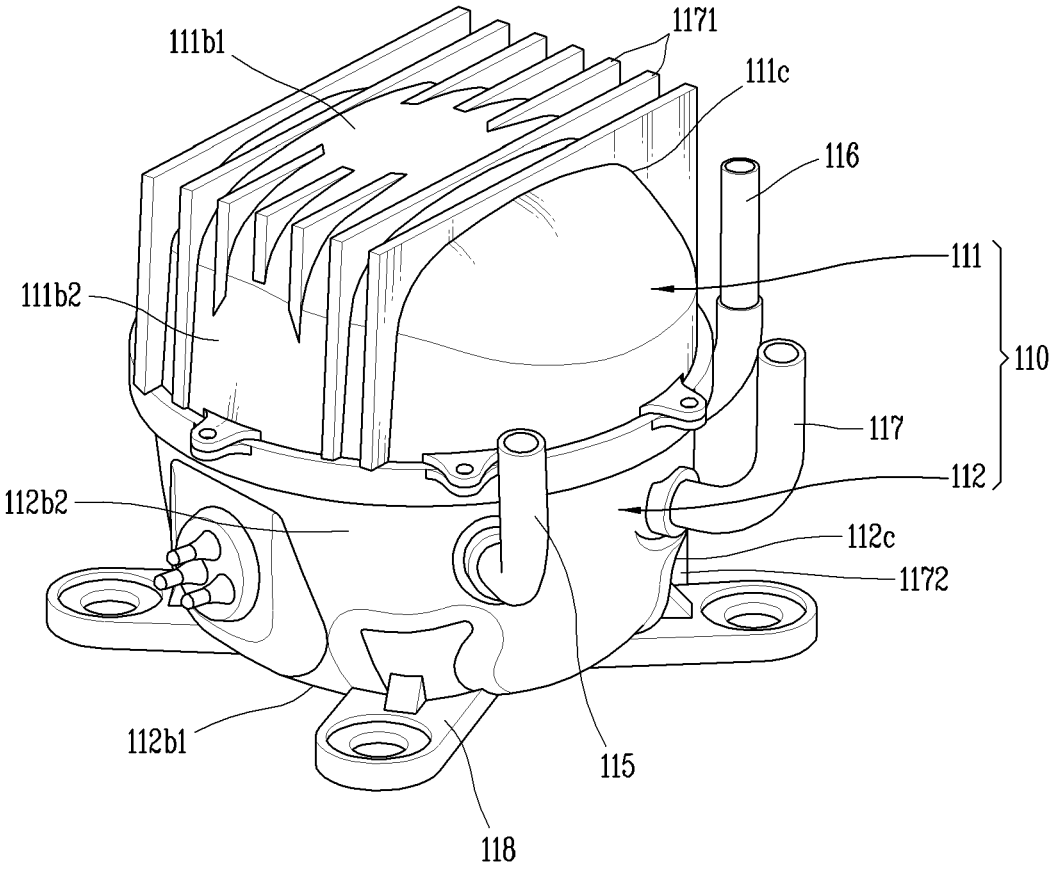
FIG. 5 is a perspective view showing an example small compressor.
Figure 6:
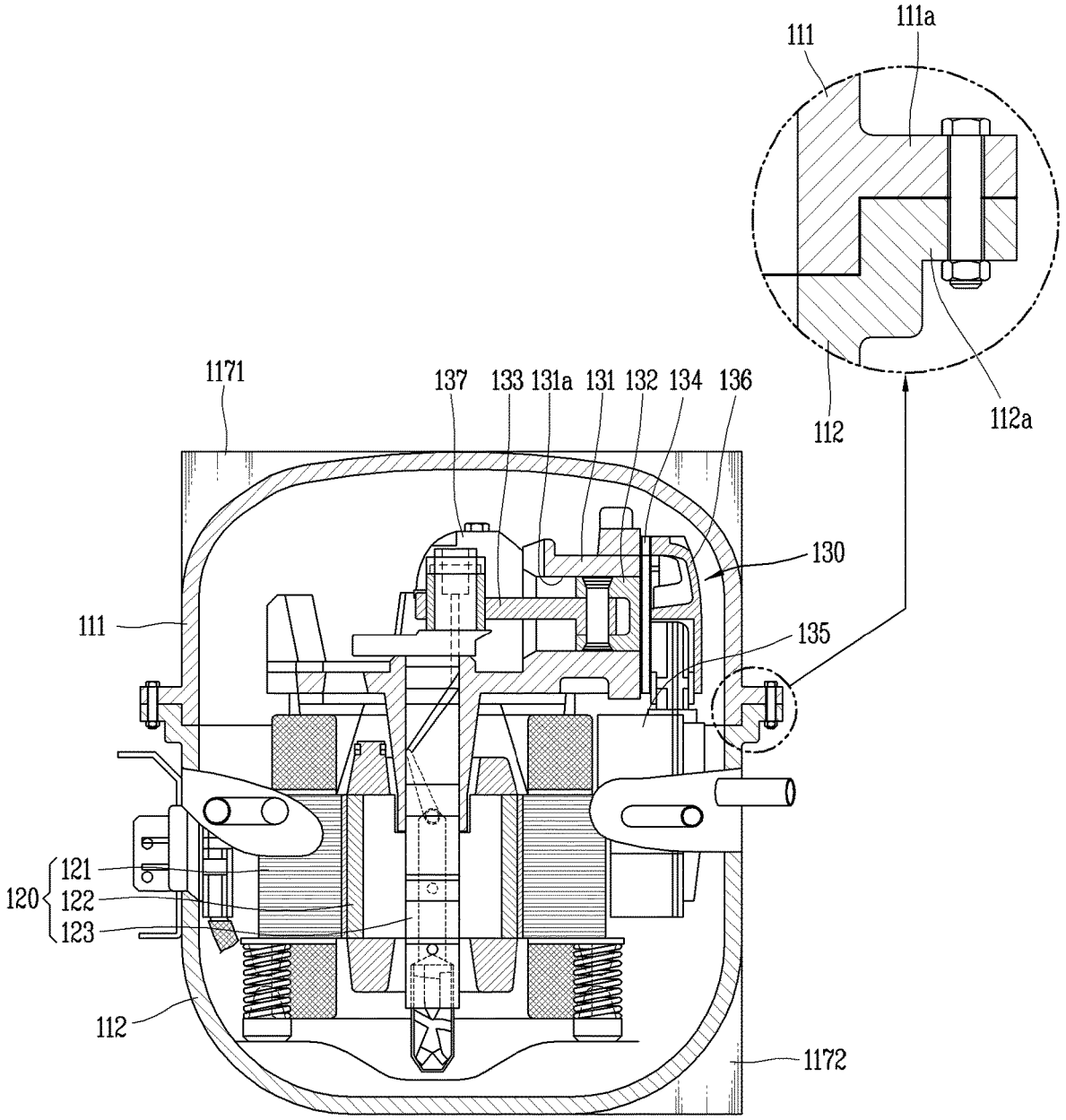
FIG. 6 is a cross-sectional view showing an example of an inside of the small compressor in FIG. 5.

FIG. 5 is a perspective view showing an examples a small compressor, and FIG. 6 is a cross-sectional view showing an inside of the small compressor according to FIG. 5. Referring to FIGS. 5 and 6, the small compressor 100 includes a shell 110 forming an external appearance, an electric motor unit 120 provided in an inner space of the shell 110 to provide a driving force, and a compression unit 130 configured to receive the driving force from the electric motor unit 120 to compress refrigerant while the piston 132 reciprocates linearly in the cylinder 131*a*.

The shell 110 forms an enclosed space therein to accommodate the electric motor unit 120 and the compression unit 130 in the enclosed space. The shell 110 is made of an aluminum alloy (hereinafter, abbreviated as aluminum) having light weight and high heat transfer coefficient, and includes the cover shell 111 and the base shell 112.

The cover shell 111 forms an enclosed inner space together with the base shell 112 and is formed in an approximately hemispherical shape like the base shell 112. The cover shell 111 is packaged with the base shell 112 on an upper side of the base shell 112 to form an enclosed space inside the shell 110.

The cover shell 111 and the base shell 112 may be welded and packaged, but the cover shell 111 and the base shell 112 may be bolt-fastened together as they are made of an aluminum material difficult to weld.

To this end, fastening protrusion portions 111*a*, 112*a* may be respectively protruded in a radial direction on the opening surfaces of the cover shell 111 and the base shell 112 so as to correspond to each other, and fastening holes for bolt assembly may be formed on the fastening protrusion portions 111*a*, 112*a*.

The base shell 112 is formed in a substantially hemispherical shape like the cover shell 111. A suction pipe 115, a discharge pipe 116 and a process pipe 117 are respectively mounted on the base shell 112. The suction pipe 115 allows refrigerant to flow into an inner space of the shell 110, and the discharge pipe 116 discharges compressed refrigerant in the shell 110, and the process pipe 117 is provided to fill refrigerant into the internal space of the shell 110 after sealing the internal space of the shell 110, and mounted through the base shell 112 like the suction pipe 115 and the discharge pipe 116.

Figure 7:
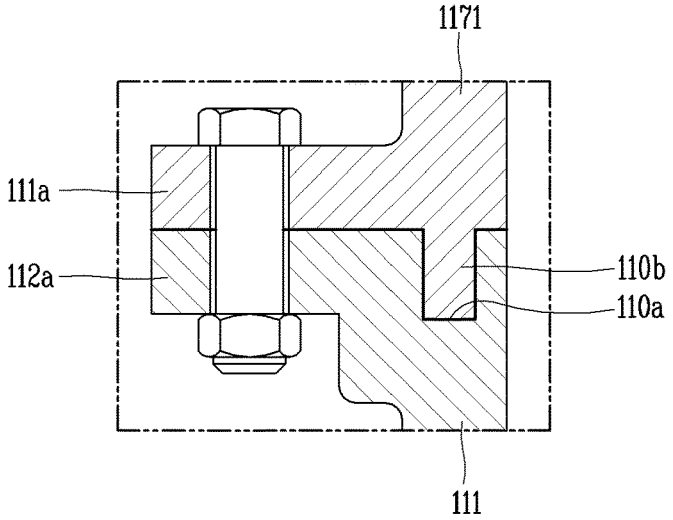
FIG. 7 is a cross-sectional view showing an example of an assembly structure of a cover shell and a base shell in a shell of a small compressor.

In some implementations, an opening surface of the cover shell 111 and an opening surface of the base shell 112 may be respectively formed to be flat and closely coupled to each other, but the opening surface of the base shell 112 may be stepped, and thus the opening surface of the base shell 112 may be coupled to the opening surface of the cover shell 111 in a stepped manner as shown in FIG. 6 or a groove 110*a* may be formed on the opening surface of the base shell 112 and a protrusion 110*b* provided on the opening surface of the cover shell 111 is inserted into the groove 110*a* and thus both the opening surfaces may be concavely and convexly coupled to each other as shown in FIG. 7. Accordingly, even when a sealing area between the opening surface of the cover shell 111 and the opening surface of the base shell 112 is increased such that the cover shell 111 and the base shell 112 are coupled by bolt fastening rather than welding, the inner space may be tightly sealed. FIG. 7 is a cross-sectional view showing another example of an assembly structure of a cover shell and a base shell in a shell of a small compressor.

In some implementations, a sealing member such as a gasket or an O-ring may be further provided between an opening surface of the cover shell 111 and an opening surface of the base shell 112. As a result, a sealing force between the cover shell 111 and the base shell 112 may be further enhanced.

In some implementations, a plurality of heat radiation fins 1171, 1172 for radiating heat may be respectively formed on the outer circumferential surfaces of the cover shell 111 and the base shell 112. In some examples, the heat radiation fins may be formed only on an outer circumferential surface of the cover shell 111, not on an outer circumferential surface of the base shell 112, in consideration of the fact that heat is directed upward. In some examples, the heat radiation fins 1171, 1172 are respectively formed on the cover shell 111 and the base shell 112 such that a surface area of the heat radiation fin 1172 formed on the cover shell 111 is larger than that of the heat radiation fin 1172 formed on the base shell 112. The heat radiation fins 1171, 1172 are extended in a single body to the shell 110, and the heat radiation fins will be described later.

The electric motor unit 120 may include a stator 121 elastically supported and provided in an inner space of the shell 110, a rotor 122 rotatably provided at an inner side of the stator 121, and a crankshaft 123 coupled to the center of the rotor 122 to transmit a rotational force to the compression unit 130.

The compression unit 130 may include a cylinder block 131 forming a cylinder 131*a*, a piston 132 compressing refrigerant while reciprocating in a radial direction within the cylinder 131*a*, a connecting rod 133 an end of which is rotatably coupled to the piston 132 and the other end of which is rotatably coupled to the crankshaft 123 to convert the rotational motion of the electric motor unit 120 into a linear motion of the piston 132, a valve assembly 134 coupled to an end of the cylinder block 131 and provided with a suction valve and a discharge valve, a suction muffler 135 coupled to a suction side of the valve assembly 134, a head cover 136 coupled to accommodate a discharge side of the valve assembly 134, and a discharge muffler 137 communicated with the head cover 136 to attenuate discharge noise of refrigerant.

The foregoing small compressor operates as follows.

In other words, when power is applied to the electric motor unit 120, the rotor 122 rotates. When the rotor 122 rotates, the crankshaft 123 coupled to the rotor 122 transmits a rotational force to the piston 132 through the connecting rod 133 while rotating. The piston 132 reciprocates in a front-rear direction with respect to the cylinder 131*a* by the connecting rod 133.

For example, when the piston 132 is retracted from the cylinder 131*a*, an internal volume of the cylinder 131*a* is increased, and when the internal volume of the cylinder 131*a* is increased, refrigerant filled in an inner space of the shell 110 is suctioned into the cylinder 131*a* of the cylinder block 131 through the suction muffler 135.

In another, when the piston 132 is advanced in the cylinder 131*a*, an internal volume of the cylinder 131*a* is reduced, and when the internal volume of the cylinder 131*a* is reduced, refrigerant filled in the cylinder 131*a* is compressed to discharge the refrigerant to the head cover 136 through the discharge valve of the valve assembly 134. A series of processes of discharging the refrigerant through the discharge muffler 137 to the cooling cycle are repeated.

At this time, motor heat is generated in the electric motor unit 120 while generating a rotational force, and compression heat is generated in the compression unit 130 while compressing refrigerant. The motor heat and the compression heat are cooled while exchanging heat with refrigerant or oil suctioned into the inner space of the shell 110, and the refrigerant and the oil are cooled come into contact with an inner circumferential surface of the shell 110 while being in contact with an inner circumferential surface of the shell to exchange heat with the shell 110. Therefore, the heat generated in the inner space of the shell 110 is eventually emitted into an inside of the machine room 22 through a surface of the shell 110.

Accordingly, the heat radiation effect of the compressor may be determined by the material and surface area of the shell 110. As described above, though heat radiation effect can be enhanced as the shell 110 is formed of an aluminum material having a high heat transfer coefficient, since the compressor is miniaturized, heat emission area, that is, the surface area, is reduced by about 70% as compared with a compressor applied to a conventional household refrigerator. Due to this, even though the material of the compressor is changed to an aluminum material favorable to heat emission, the heat radiation effect of the compressor may be reduced as the heat emission area as a whole is reduced.

As a result, in the present implementation, as described above, a plurality of heat radiation fins are formed on an outer circumferential surface of the shell to enlarge the heat emission area, thereby securing a large heat emission area of the shell to enhance the heat radiation effect even when the compressor is miniaturized.

In some cases, when the heat radiation fins are uniformly formed on an entire outer circumferential surface of the shell, a size of an actual compressor defined by an end portion surface of the heat radiation fin is larger than the outer circumferential surface of the shell. Therefore, it may seriously undermine the advantages of miniaturizing the compressor. Therefore, in the present implementation, when forming the heat radiation fin, it can be preferable to reduce a dead angle or dead volume as much as possible not to increase the actual size of the compressor including the heat radiation fin.

Figure 8:
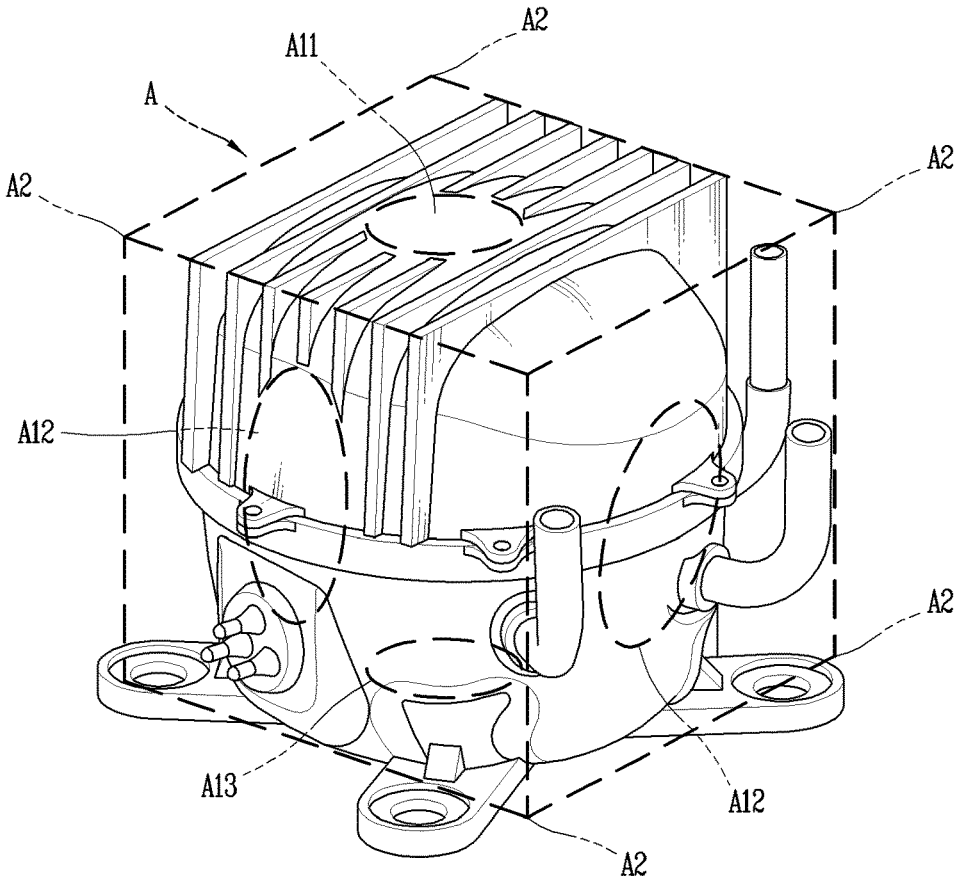
FIG. 8 is a schematic view showing an example of an appearance of a small compressor.
Figure 9A:
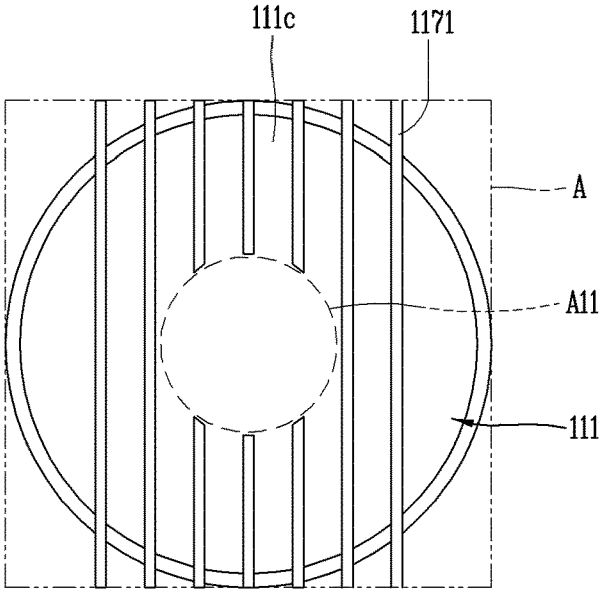
FIGS. 9A and 9B are schematic views showing the small compressor in FIG. 8 seen from an upper side and a lateral side, respectively.
Figure 9B:
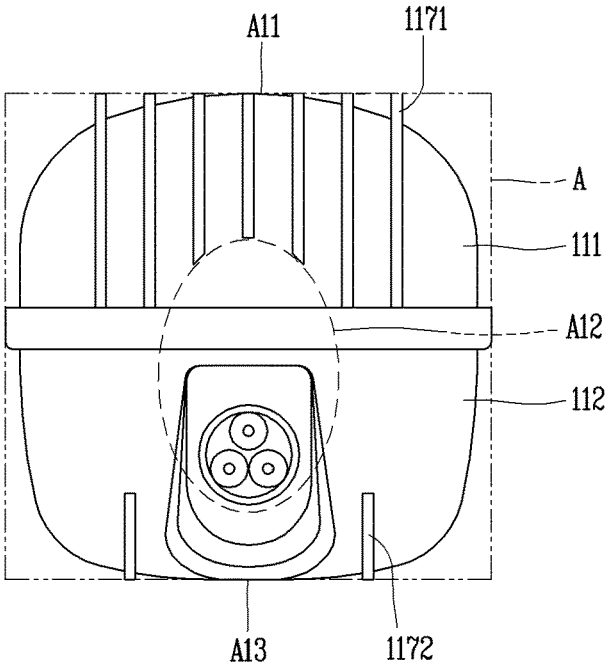

FIG. 8 is a schematic view for explaining an example of an appearance of a small compressor, and FIGS. 9A and 9B are schematic views in which the small compressor according to FIG. 8 is seen from the upper side and the lateral side.

Referring to FIG. 8, an outer circumferential surface of the shell 110 of the compressor 100 may be formed in a spherical shape. However, the outer circumferential surface of the shell 110 does not mean a perfect spherical shape having a full circle. Depending on the shape of the compressor body, it may be an elliptical sphere, or a part of the surface thereof may be planar or have a surface that is substantially planar. However, for convenience of explanation, the shell is defined such that an outer circumferential surface thereof is formed in a spherical shape.

For example, a cross-sectional area of the shell 110 increases as it goes from the upper central region (A11) to the side central region (A12), and a cross sectional area thereof decreases as it goes from the side central region (A12) to the bottom central portion (A13). At this time, a figure (A) formed by connecting the upper central portion (A11), the side central region (A12), and the bottom central region (A13) together with the heat radiation fins 1171, 1172 substantially forms a hexahedron.

Therefore, an outer circumferential surface of the shell 110 has a curvature smaller than that of the corner area (A2) even when the central regions (A11, A12, A13) of each surface are substantially planar or curved when viewed based on the hexahedron. The eight corner regions (A2) may be curved.

Referring to FIG. 9A, in the small compressor, a plurality of heat radiation fins 1171 are formed parallel to the center of the upper central region (A11). Accordingly, a virtual figure connecting the plurality of the heat radiation fins 1171 with the side surfaces of the shell 110 constitutes a quadrangle.

Referring to FIG. 9B, in the small compressor, a plurality of heat radiation fins 1171, 1172 are formed on the cover shell 111 and the base shell 112, respectively, around the central region (A12). Accordingly, a virtual figure connecting a plurality of heat radiation fins 1171, 1172 with the upper central region (A11), the side central region (A12) and the bottom central region (A13) of the shell 110 constitutes a quadrangle.

Figure 10:
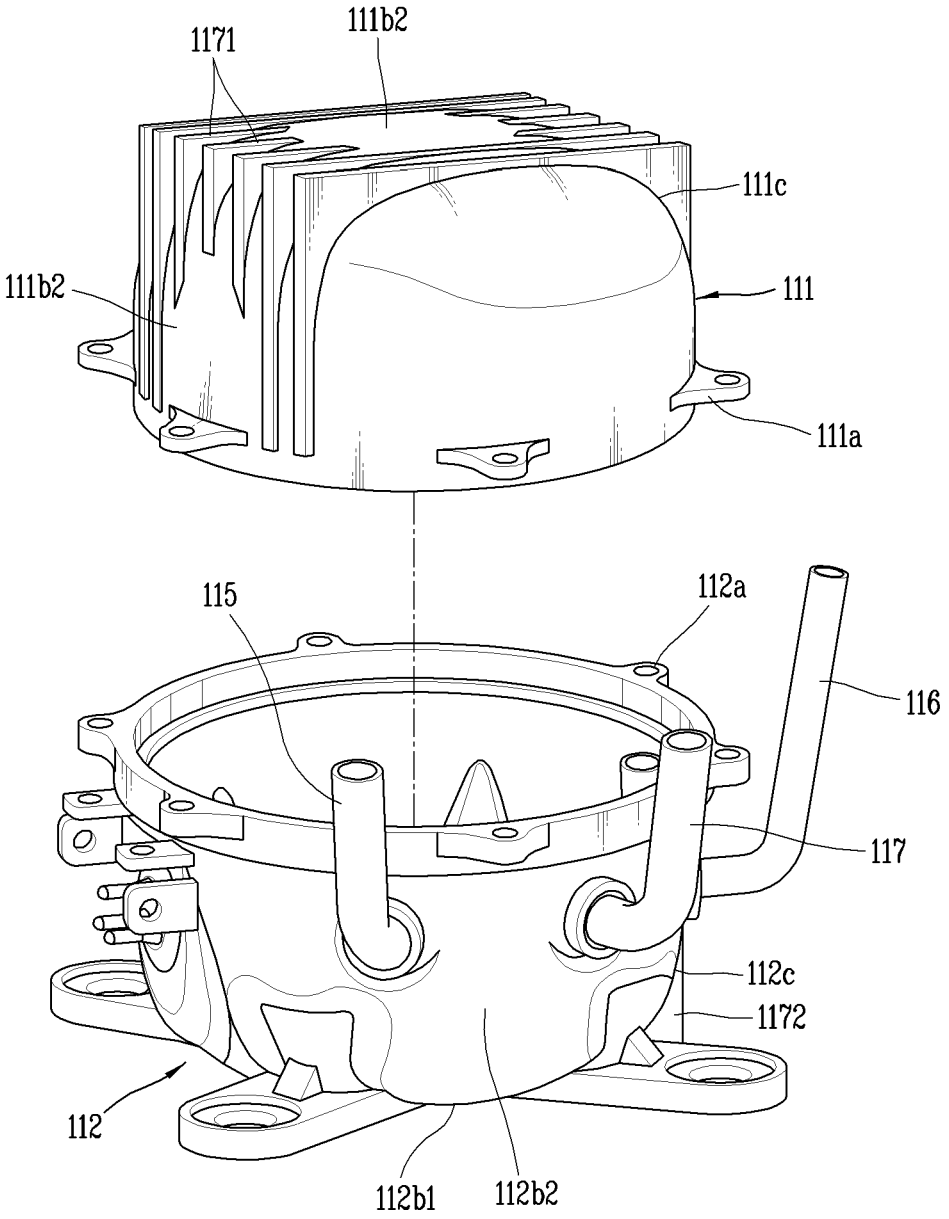
FIGS. 10 and 11 are an exploded perspective view and an assembled front view that respectively show an appearance of an example small compressor.
Figure 11:
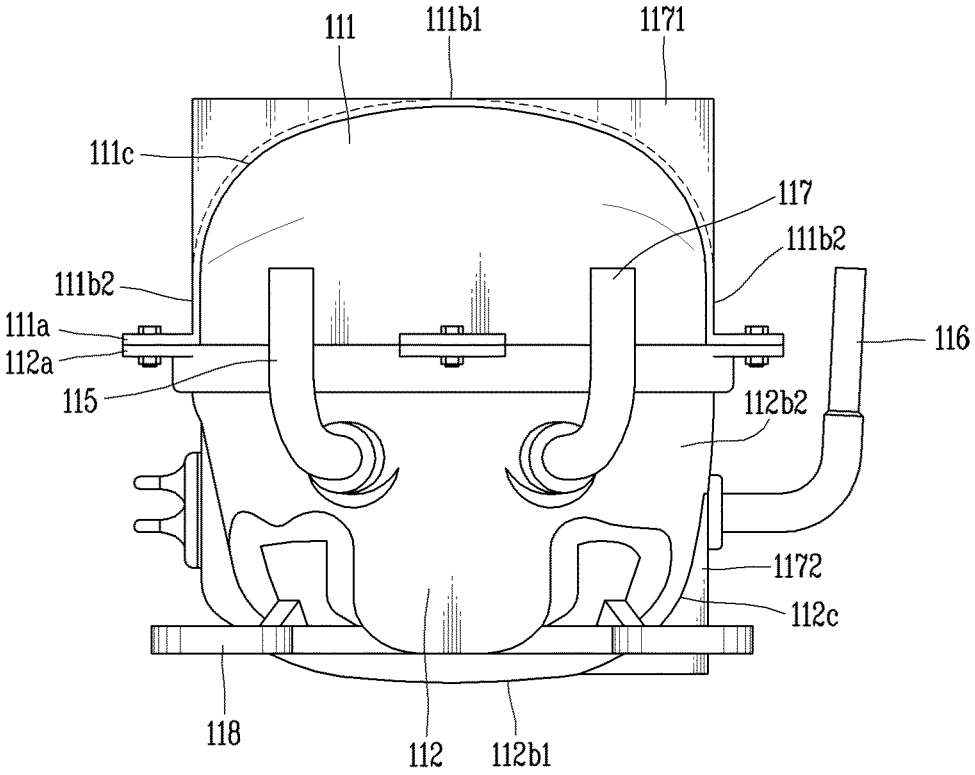
Figure 12:
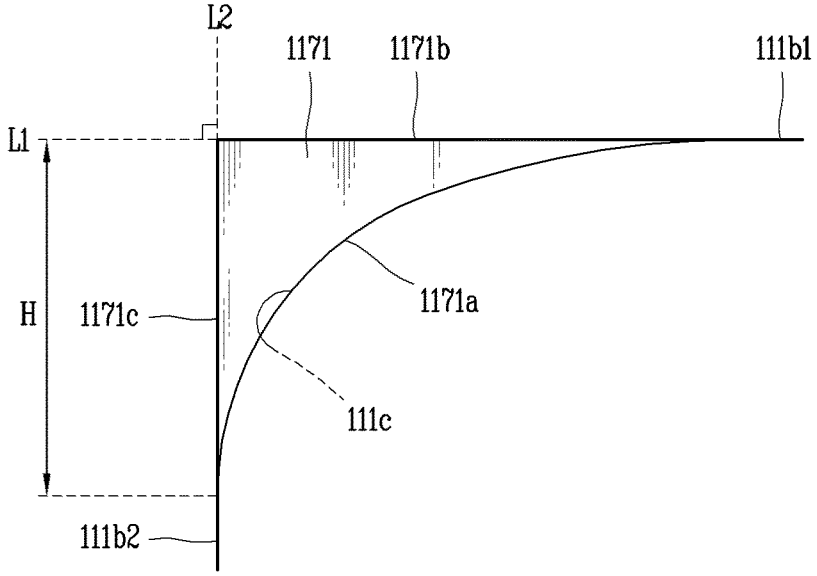
FIG. 12 is a schematic view showing an example of a first heat radiation fin in FIG. 11.

FIGS. 10 and 11 are an exploded perspective view and an assembled front view, respectively, showing an appearance of a small compressor, and FIG. 12 is a schematic view for explaining an example of a first heat radiation fin in FIG. 11.

Referring to FIGS. 10 and 11, curved edge portions 111*c*, 112*c* are formed between the upper central portion and the side central portion of the shell 110 or between the bottom central portion and the side central portion thereof when viewed based on an imaginary hexahedron. The heat radiation fins 1171, 1172 may be formed on the curved edge portions 111*c*, 112*c*.

For example, as described above, an appearance of the cover shell 111 substantially forms an upper half of the hexahedron, and the edge portion forms a curved hemispherical shape. Accordingly, the upper central region of the cover shell 111 is formed with an upper side portion 111*b*1 having a flat or predetermined curvature, and the side central portion is formed with a side wall portion 111*b*2 having a substantially planar or predetermined curvature. A cover side edge portion 111*c* connecting the upper side portion 111*b*1 and the side wall portion 111*b*2 with a curved surface is formed at an edge of the cover shell 111. The cover side edge portion 111*c* is formed such that a transverse cross-sectional area of the shell 110 with respect to an inner space of the shell 110 becomes smaller as it goes from an opening surface of the cover shell 111 to an upper surface thereof.

The first heat radiation fin 1171 is formed on the cover side edge portion 111*c* of the cover shell 111, and the first heat radiation fin 1171 is formed only up to a point where the cover side edge portion 111*c*, the upper side portion 111*b*1 and the side wall portion 111*b*2 are connected. Here, when the cover shell 111 is formed in a hemispherical shape having a full circle, and an upper central portion of the cover shell 111 is formed as one point, the one point may be defined as an upper side portion 111*b*1.

As shown in FIG. 12, the first heat radiation fin 1171 has a curved portion 1171*a* extended from an outer circumferential surface of the cover shell 111, a horizontal portion 1171*b* extended in a direction perpendicular to an axial direction from an upper end of the curved portion 1171*a*, and a vertical portion 1171*c* extended in an axial direction from a lower end of the curved portion 1171*a* to connect the horizontal portion 1171*b*. Accordingly, the first heat radiation fin 1171 may be formed such that an edge where the horizontal portion 1171*b* and the vertical portion 1171*c* are joined at a right angle or a substantially right angle.

Furthermore, a height (H) of the horizontal portion 1171*b* and the vertical portion 1171*c* constituting an end portion surface of the first heat radiation fin 1171 is formed to extend to the same straight line L1, L2 as the upper side portion 111*b*1 and the side wall portion 111*b*2 of the cover shell 111 or formed lower than the upper side portion 111*b*1 and the side wall portion 111*b*2. Accordingly, the first heat radiation fin 1171 is not formed on the upper side portion 111*b*1 and the side wall portion 111*b*2, but formed only on the edge portion 111*c*. Therefore, a size of the actual compressor does not increase while forming the heat radiation fin.

In other words, when an outer surface of the cover shell 111 is formed in a substantially hemispherical shape, an edge portion is a type of dead angle area or dead volume area, and the first heat radiation fin 1171 is formed in an edge portion which is a dead angle area or dead volume area, and thus a new dead angle or dead volume is not generated due to the heat radiation fin.

Figure 13:
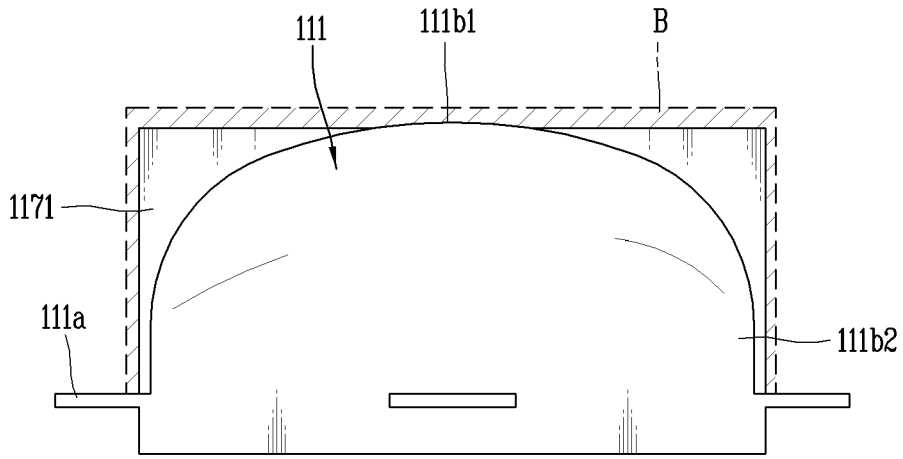
FIG. 13 is a schematic view for explaining an effect for the shape of a heat radiation fin.

Here, the dead angle area or dead volume area denotes a vacant space in the machine room, and when the heat radiation fins protrude from the upper side portion or the side wall portion, a substantially outer surface of the compressor becomes an end portion surface of the heat radiation fin. Therefore, the machine room must be enlarged by an area of the heat radiation fins formed to protrude from the upper side portion or the side wall portion, so that the shaded area B becomes a rectangular area or a carcass area. The present implementation is presented not to generate an additional dead angle area or dead volume area. FIG. 13 is a schematic view for explaining an example of an effect for the shape of a heat radiation fin.

Accordingly, the compressor does not increase a substantial size of the compressor including a heat radiation fin while forming the heat radiation fin.

On the other hand, as shown in FIGS. 3 through 13, the first heat radiation fins 1171 are formed to be long in a longitudinal direction (or axial direction) and thin in a transverse direction (or radial direction), and the first heat radiation fins 1171 may be arranged parallel to a side surface of the cover shell 111. In other words, the first heat radiation fin 1171 is formed on the edge portion 111*c*, and formed parallel to the side wall portion 111*b*2. Accordingly, the first heat radiation fins 1171 may be arranged in a vertical straight-line shape. Furthermore, when there are a plurality of the first heat radiation fins 1171, the first heat radiation fins 1171 may be formed parallel to each other at preset intervals along the transverse direction.

Figure 14:
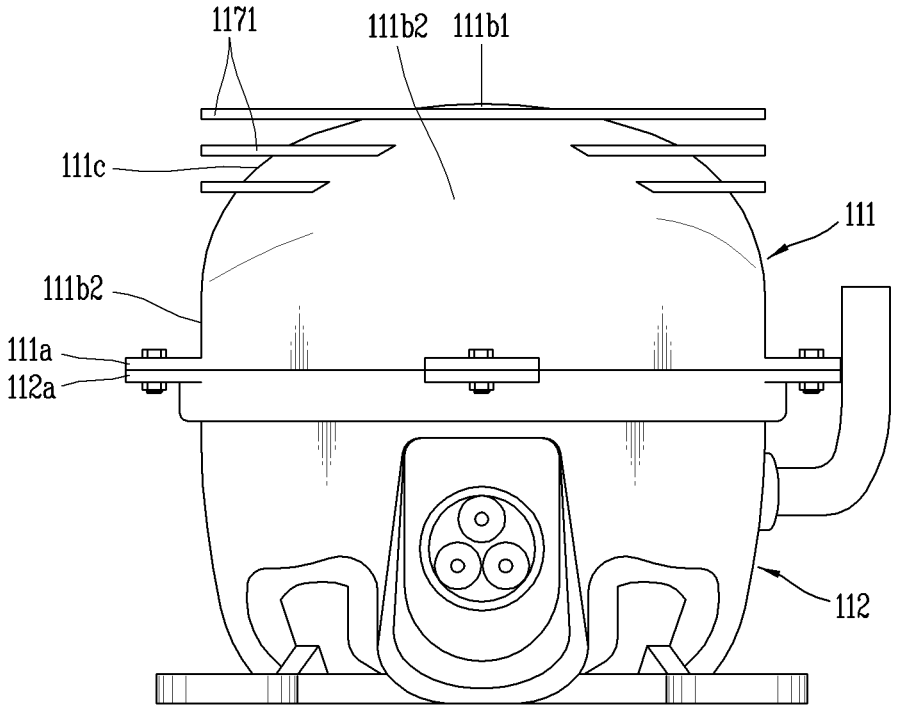
Figure 15:
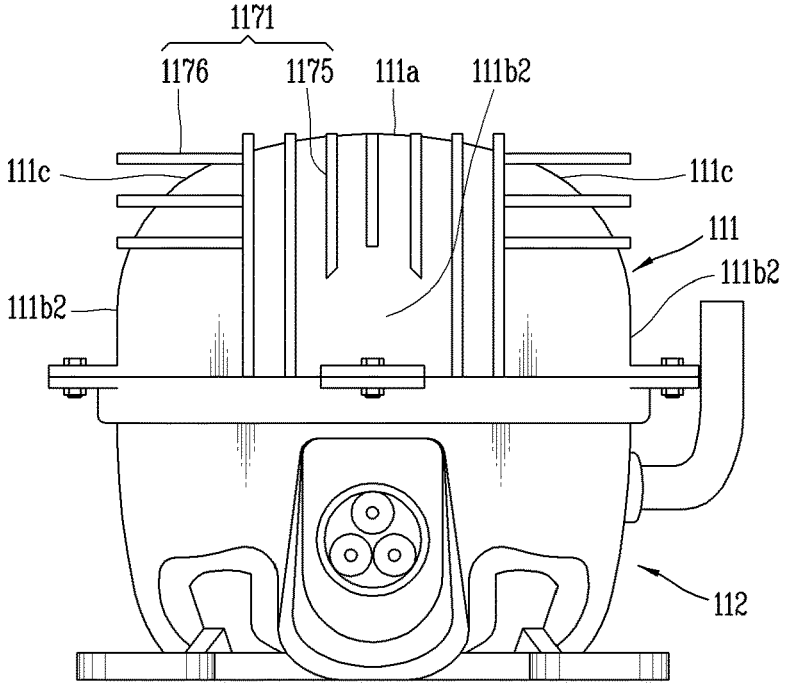
Figure 16:
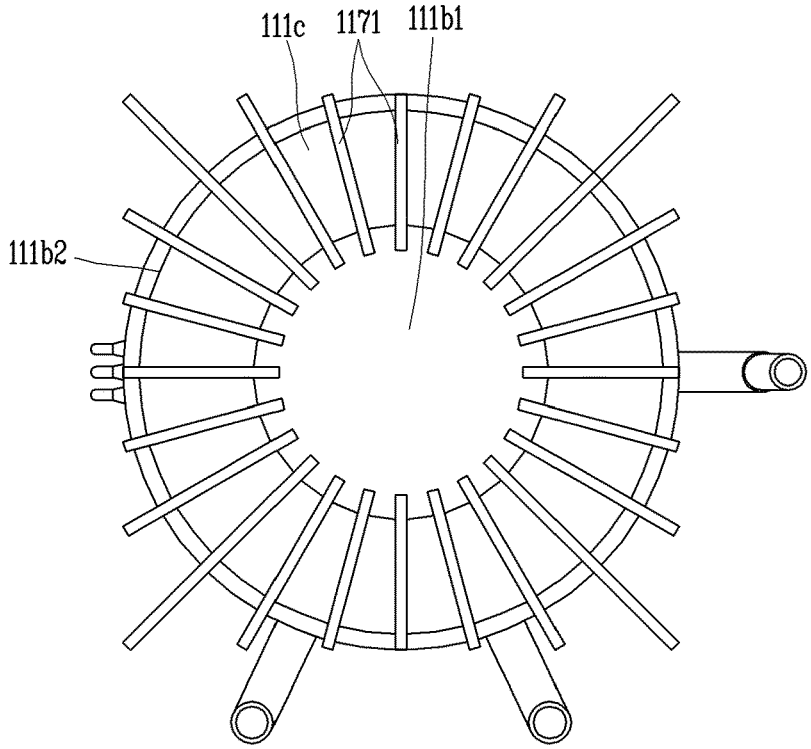

However, the first heat radiation fin according to the present disclosure is not limited to the above-described arrangement shape. FIGS. 14 to 16 are views showing other implementations and the arrangement shape of a first heat radiation fin, in which FIGS. 14 and 15 are front views seen from the condenser side, and FIG. 16 is a plan view seen from the upper side. In some implementations, the first heat radiation fin may have the same shape comprising a curved portion, a horizontal portion and a vertical portion.

For example, as shown in FIG. 14, the first heat radiation fin 1171 may be formed parallel to the upper side portion 111*b*1. In this case, a plurality of first heat radiation fins 1171 may be formed in the edge portion 111*c* at preset intervals along the longitudinal direction, and may be formed parallel to the upper side portion 111*b*1. Accordingly, the first heat radiation fins 1171 may be arranged in a vertical straight line shape.

In addition, as shown in FIG. 15, the first heat radiation fins 1171 may be formed to have different directions. For example, a vertical side heat radiation fin 1175 perpendicular to the upper side portion 111*b*1 and a horizontal side heat radiation fin 1176 perpendicular to the side wall portion 111*b*2 may be respectively formed. A part of the vertical side heat radiation fin 1175 and the horizontal side heat radiation fin 1176 may be formed in an integrally extended manner. Accordingly, the first heat radiation fins 1171 may be arranged in a lattice shape in which a part thereof is mixed in a vertical and horizontal manner.

In addition, as shown in FIG. 16, the first heat radiation fins 1171 may be formed to be arranged radially with respect to the center of the upper side portion 111*b*1. Even in this case, the first heat radiation fins 1171 may preferably be formed only on the edge portion 111*c* of the cover shell 111.

Figure 17:
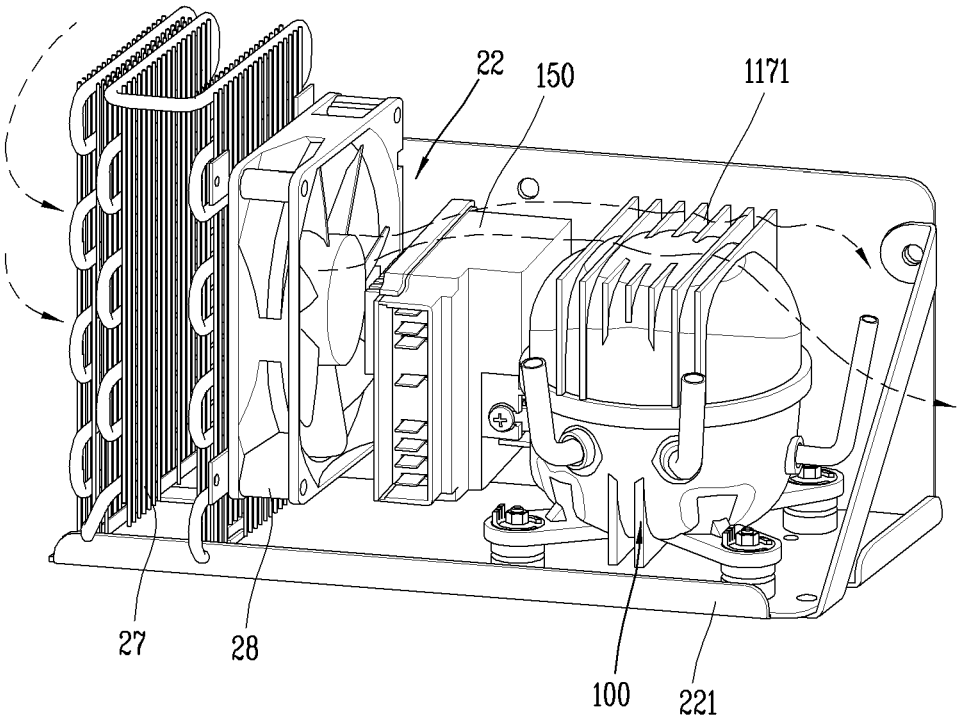
FIG. 17 is a front view showing another implementation of a first heat radiation fine and an example arrangement shape of the first heat radiation fin.

In addition, the first heat radiation fins 1171 of the foregoing implementations are formed in a forward direction with respect to the flow direction of air. In some examples, the first heat radiation fins may be arranged in a direction intersecting with the flow direction of air. FIG. 17 is a front view showing still another implementation of the arrangement shape of a first heat radiation fin according to the present disclosure.

Referring to FIG. 17, the first heat radiation fins 1171 may be arranged in a direction perpendicular to the flow direction of air. Accordingly, air that has passed through the condenser 27 stays in the machine room 22 for a long period of time while colliding with the first heat radiation fins 1171 to form a turbulent flow, and when the condensing fan 28 is not used due to this, it may be possible to enhance contact between the air and the first heat radiation fins 1171.

On the other hand, the case of the base shell 112 is similar. For example, the lower side portion 112*b*1 constituting a bottom central region of the base shell 112 and a base side wall portion 1122*b* constituting a side central region thereof may be formed substantially planar or formed to be smaller than the curvature of the edge portion 112*c* even when curved.

The edge portion 112*c* is a portion connecting the lower side portion and the side wall portion, and the second heat radiation fin 1172 is formed on the curved edge portion 112*c*.

The shape of the second heat radiation fin 1172 is the same as that of the first heat radiation fin 1171 described above. In other words, the second heat radiation fin 1172 is formed with a curved portion, a horizontal portion, and a vertical portion.

In some examples, for the heat radiation fins, a surface area of the first heat radiation fin 1171 formed on the cover shell 111 may be formed larger than that of the second heat radiation fin 1172 formed on the base shell 112. It is because heat generated in an inner space of the shell 110 moves to the upper side due to its characteristics, and thus heat is mainly exchanged with the cover shell 111. Accordingly, a surface area of the first heat radiation fins 1171 formed on the cover shell 111 may preferably be formed larger than that of the second heat radiation fins 1172 formed on the base shell 112 in order to enhance a heat radiation effect on the shell 110.

In some implementations, the second heat radiation fin 1172 may be formed in a vertical straight line manner, a horizontal straight line manner, a lattice shape, or a radial shape as the first heat radiation fin 1171.

In some implementations, a support portion 118 for supporting the shell 110 may be formed on the bottom portion of the base shell 112. The support portion 118 extends radially from the edge portion of the base shell 112, and an elastic member 1181 is inserted into and coupled to an end portion of the support portion 118.

The support portion 118 may be assembled and fixed to the bottom portion of the base shell 112, but as the base shell 112 is manufactured by a die casting method, the support portion 118 may be preferably formed into a single body together with the base shell 112.

As described above, the shell 110 is formed of an aluminum material having a high heat transfer coefficient. Accordingly, even when the surface of the shell 110 is formed significantly smaller than that of the shell of a compressor in the related art, heat generated in an inner space of the shell 110 may be rapidly emitted.

Furthermore, as a plurality of heat radiation fins 1171, 1172 are integrally formed on the surface of the shell 110, even when the surface area of the shell 110 is small, the overall heat emission area may be enlarged to rapidly emit heat generated in the inner space of the shell 110.

Furthermore, as the heat radiation fins 1171, 1172 formed on the surface of the shell 110 are formed in a dead angle area or dead volume area of the spherical shell 110, it may be possible to suppress a substantial size of the shell 110 from being increased while the heat radiation fins 1171, 1172 are protruded from the surface of the shell 110. Accordingly, it may be possible to prevent a volume of the machine room from increasing due to the heat radiation fins when the small compressor is installed in a small refrigerator. Through this, it may be possible to secure a large area of the storage space compared to the refrigerator of the same capacity.

On the other hand, as described above, the small compressor may be installed in a machine room in a small refrigerator. In this case, the small compressor may be arranged in the order of the condenser-condensing fan-compressor.

Here, the air inlet 22*a* is formed on a left side of the machine room 22, and the air outlet 22*b* is formed on a right bottom side of the machine room 22, respectively. Therefore, the condenser 27 and the compressor 100 may be arranged at a position in proximity to the air inlet 22*a* and at a position in proximity to the air outlet 22*b* of the machine room 22, respectively. In some examples, the compressor 100 may be less affected by air than the condenser 27 due to its characteristics, and thus the compressor 100 may not greatly affect the performance of the refrigerator even if it comes into contact with air at a higher temperature than the condenser 27. However, when the compressor 100 is small as in the present implementation, the heat emission area may be reduced to lower the heat radiating effect to the compressor, thereby increasing the operation time of the condensing fan 28.

In some implementations, when the shell 110 is made of an aluminum material and the heat radiation fins 1171, 1172 are formed on an outer circumferential surface of the shell 110 as in the present implementation, an area required for heat radiation of the compressor may be secured. Through this, the heat of the compressor 100 may be rapidly emitted without increasing the driving time of the condensing fan 28 in order to emit the heat of the compressor 100. Therefore, it may be possible to prevent power waste due to the long-time driving of the condensing fan 28, and reduce noise due to the driving of the condensing fan 28.

In some implementations, one longitudinal end of the heat radiation fins 1171 may be arranged to face the condenser 27. In this case, air that has passed through the condenser 27 may evenly come in contact with the heat radiation fins 1171, 1172 while passing through the heat radiation fins 1171, 1172. Furthermore, a flow resistance of air due to the heat radiation fins 1171, 1172 is reduced to allow fresh air to quickly flow into the machine room 22. As a result, the heat radiation effect of the condenser 27 and the compressor 100 may be further improved.

In some implementations, the heat radiation fins 1171, 1172 may be arranged in a direction horizontally and vertically orthogonal to a direction toward the condenser 27 as described above or may be arranged radially. In addition, the heat radiation fins 1171, 1172 may be arranged in a direction orthogonal to the flow direction of air.

In these cases, due to not only an enlarged area of the heat radiation fin but also a complicated shape of the heat radiation fin, air that has passed through the condenser 27 hits the heat radiations fins 1171, 1172 to form a turbulent flow. Then, air may form a complicated flow distribution in the machine room 22 to enhance contact between the air and the heat radiation fins 1171, 1172.

In some implementations, the small compressor may include a compressor controller 150 for controlling the electric motor unit 120 inside the shell 110.

Referring to FIGS. 3, 4, and 17, the compressor controller 150 may be coupled to a side surface of the base shell 112. In addition, the compressor controller 150 may generate heat higher than the shell 110. Accordingly, the compressor controller 150 may be preferably located between the condenser fan 28 and the compressor 100.

What is claimed is:

1. A compressor, comprising:

a shell that defines an enclosed space inside the shell;

an electric motor unit located in the enclosed space of the shell and configured to generate a driving force; and a compression unit located in the enclosed space of the shell and configured to compress refrigerant, the compression unit comprising a cylinder and a piston that is configured to reciprocate in the cylinder based on the driving force transmitted from the electric motor unit, wherein the shell comprises a plurality of heat radiation fins that are located at an outer circumferential surface of the shell and that are configured to emit heat generated inside the shell to an outside of the shell, wherein each of the plurality of heat radiation fins includes a horizontal portion and a vertical portion that respectively extend from the outer circumferential surface of the shell, and wherein an upper surface of the horizontal portion is disposed at a position corresponding to or below an upper central portion of the shell in an axial direction of the shell, or an outer surface of the vertical portion in a radial direction of the shell is disposed at a position corresponding to or inward of a side central portion of the shell.

2. The compressor of claim 1, wherein the shell comprises a support portion that extends from a bottom portion of the shell and that is configured to support the shell.

3. The compressor of claim 1, wherein the shell is made of an aluminum material.

4. The compressor of claim 1, wherein at least a part of the outer circumferential surface of the shell defines a curved part, and wherein each of the plurality of heat radiation fins is located at the curved part of the outer circumferential surface of the shell.

5. The compressor of claim 4, wherein the shell has the side central portion, the upper central portion located vertically above the side central portion, and a bottom central portion located vertically below the side central portion, wherein a cross-section area of the upper central portion or the bottom central portion of the shell is less than a cross-section area of the side central portion of the shell, and wherein each of the plurality of heat radiation fins is located between the upper central portion and the side central portion or between the bottom central portion and the side central portion.

6. The compressor of claim 5, wherein each of the plurality of heat radiation fins further comprises a curved portion that is in contact with the outer circumferential surface of the shell and that is disposed between the vertical portion and the horizontal portion.

7. The compressor of claim 1, wherein the shell comprises a cover shell and a base shell that are coupled to each other to define the enclosed space, wherein the cover shell defines a first opening surface, and the base shell defines a second opening surface that faces the first opening surface of the cover shell, and wherein the plurality of heat radiation fins are located at at least one of the cover shell or the base shell.

8. The compressor of claim 7, wherein a surface area of the plurality of heat radiation fins located at the cover shell is greater than a surface area of the plurality of heat radiation fins located at the base shell.

9. The compressor of claim 7, wherein the cover shell and the base shell comprise fastening protrusion portions that extend in a radial direction of the shell, that are configured to face each other, and that are located at positions corresponding to the first opening surface and the second opening surface, respectively, and wherein the base shell and the cover shell are configured to be coupled to each other by fastening bolts through the fastening protrusion portions of the cover shell and the base shell.

10. The compressor of claim 9, wherein at least one of the cover shell or the base shell comprises a stepped portion or a protrusion that is configured to couple the first opening surface and the second opening surface to each other.

11. The compressor of claim 1, wherein the outer circumferential surface of the shell comprises an upper side portion, a side wall portion, a lower side portion, and an edge portion that connects between the upper side portion and the side wall portion, wherein at least one of the plurality of heat radiation fins is located at the edge portion, and wherein the plurality of heat radiation fins and the outer circumferential surface of the shell define a hexahedron shape comprising (i) one or more first planes defined by an end portion surface of the plurality of heat radiation fins and (ii) one or more second planes defined by the outer circumferential surface of the shell.

12. The compressor of claim 11, wherein each of the plurality of heat radiation fins has a surface that extends in a direction parallel to at least one side of the hexahedron shape.

13. The compressor of claim 11, wherein each of the plurality of heat radiation fins extends in a plurality of directions that are parallel to orthogonal sides of the hexahedron shape, respectively.

14. The compressor of claim 11, wherein each of the plurality of heat radiation fins extends radially with respect to a center of at least one side of the hexahedron shape.

15. A refrigerator, comprising:

a cavity configured to store one or more food items;

a door configured to open and close at least a portion of the cavity;

a machine room that is located at a side of the cavity, the machine room defining an air path that allows an inner space of the machine room to communicate with an outside of the machine room;

a condenser located in the inner space the machine room; and a compressor located in the inner space of the machine room at a side of the condenser, wherein the compressor comprises:

a shell that defines an enclosed space and that is made of an aluminum material, an electric motor unit located in the enclosed space of the shell and configured to generate a driving force, and a compression unit located in the enclosed space of the shell and configured to compress refrigerant, the compression unit comprising a cylinder and a piston that is configured to reciprocate in the cylinder based on the driving force transmitted from the electric motor unit, and wherein the shell comprises a plurality of heat radiation fins that are located at an outer circumferential surface of the shell and that are configured to emit heat generated inside the shell to an outside of the shell, wherein each of the plurality of heat radiation fins includes a horizontal portion and a vertical portion that respectively extend from the outer circumferential surface of the shell, and wherein an upper surface of the horizontal portion is disposed at a position corresponding to or below an upper central portion of the shell in an axial direction of the shell, or an outer surface of the vertical portion in a radial direction of the shell is disposed at a position corresponding to or inward of a side central portion of the shell.

16. The refrigerator of claim 15, wherein each of the plurality of heat radiation fins extends toward the condenser.

17. The refrigerator of claim 15, wherein each of the plurality of heat radiation fins extends in a first direction perpendicular to a second direction extending toward the condenser.

18. The refrigerator of claim 15, wherein the machine room comprises:

an air inlet configured to receive air from the outside of the machine room; and an air outlet spaced apart from the air inlet and configured to discharge air to the outside of the machine room, the air path extending from the air inlet toward the air outlet, and wherein the condenser and the compressor are located between the air inlet and the air outlet.

19. The refrigerator of claim 18, further comprising a fan located between the condenser and the compressor.

20. The refrigerator of claim 19, further comprising a controller that is configured to control the compressor, that is coupled to the shell of the compressor, and that is located between the fan and the shell of the compressor.

* * * * *